United States Patent [19]

Shimazaki

[11] Patent Number: 4,806,974

[45] Date of Patent: Feb. 21, 1989

[54] APPARATUS FOR REPRODUCING A COPY IMAGE ACCORDING TO EITHER A POSITIVE ORIGINAL IMAGE OR A NEGATIVE ORIGINAL IMAGE

[75] Inventor: Takashi Shimazaki, Yokohama, Japan

[73] Assignee: Kabushiki Kaisha Toshiba, Kawasaki, Japan

[21] Appl. No.: 114,064

[22] Filed: Oct. 29, 1987

[30] Foreign Application Priority Data

Nov. 12, 1986 [JP] Japan ..... 61-268982

[51] Int. Cl.[4] ..... G03G 15/00

[52] U.S. Cl. ..... 355/5; 355/3 R

[58] Field of Search ..... 355/5, 3 R, 77; 430/31, 430/100

[56] References Cited

U.S. PATENT DOCUMENTS 3,674,354 7/1972 Artaud et al. ..... 355/5
3,738,744 6/1973 Cassano et al. ..... 355/5 X
4,341,463 7/1982 Kashiwagi .
4,678,314 7/1987 Uchida et al. ..... 355/5

*Primary Examiner*—R. L. Moses
*Attorney, Agent, or Firm*—Foley & Lardner, Schwartz, Jeffery, Schwaab, Mack, Blumenthal & Evans

[57] ABSTRACT

A microfilm reader printer has a reader unit which projects a microfilm image onto a screen and a printer unit which reproduces copies of the microfilm image. The printer unit includes an optical device for forming the electrostatic image on a photoreceptor by exposing the microfilm image onto the photoreceptor and a developing device for visualizing the electrostatic latent image formed on the photoreceptor. The developing device has a developing unit for achieving reversal development. The photoreceptor receives a uniformly recharging process by a recharging unit and an overall exposure by an exposure unit. Then, the developed image is removed and the latent image is reversely developed again by the developing unit. A positive copy may be reproduced from both positive and negative types of a microfilm by selectively operating the recharging unit, exposure unit and developing unit.

12 Claims, 11 Drawing Sheets

APPARATUS FOR REPRODUCING A COPY IMAGE ACCORDING TO EITHER A POSITIVE ORIGINAL IMAGE OR A NEGATIVE ORIGINAL IMAGE

BACKGROUND OF THE INVENTION

This invention relates to an image forming apparatus, more specifically, the invention relates to an apparatus for reproducing a copy image according to either a positive original image or a negative original image.

There is known a microfilm reader printer for projecting a reduced image recorded on a microfilm onto a screen and reproducing copies of the desired image recorded on the microfilm. Generally, the recorded images of microfilms are roughly classified into two categories, i.e., positive images and negative images. Therefore, two types of developing processes are performed in order to reproduce a copy image from these two different kinds of microfilm images. To meet this requirement, a first developing device for reproducing a positive copy image from a positive microfilm image and a second developing device for reproducing a positive copy image from a negative microfilm image are mounted on the machine and only one of these developing devices is activated according to the kind of microfilm images.

An example of such an apparatus is disclosed in U.S. Pat. No. 4,341,463. This microfilm reader printer has a first developing station for normal development and a second developing station for reversed development. Each developing station contains a liquid developer, a pump and a pipe, respectively. It is, therefore, difficult to achieve lightweight and low-cost arrangements.

SUMMARY OF THE INVENTION

Accordingly, it is an object of the present invention to provide an image forming apparatus which may reproduce a positive copy image from either a positive or negative original image.

Another object of the present invention is to provide an image forming apparatus which may achieve lightweight and low-cost arrangements.

These and other objects of the invention are achieved by providing an improved apparatus for forming a positive copy image on an image carrier from one of a negative and positive original images including means for uniformly charging the image carrier, means for exposing one of the negative and positive original images to the image carrier so as to form an electrostatic latent image thereon, means for reversely developing the electrostatic latent image by applying developers so as to reproduce a visible image, means for uniformly recharging the image carrier having the visible image corresponding to the positive original image and developed by the reversely developing means, means for uniformly discharging the image carrier recharged by the uniformly recharging means and means for removing the developers on the visible image developed by the reversely developing means and for depositing the developer onto the image carrier so as to produce the positive copy image corresponding to the positive original image.

BRIEF DESCRIPTION OF THE DRAWINGS

These and other objects and advantages of the invention will become more apparent and more readily appreciated from the following detailed description of the preferred embodiments of the invention taken in conjunction with the accompanying drawings, in which.

DETAILED DESCRIPTION OF THE PREFERRED EMBODIMENTS

Figure 1:
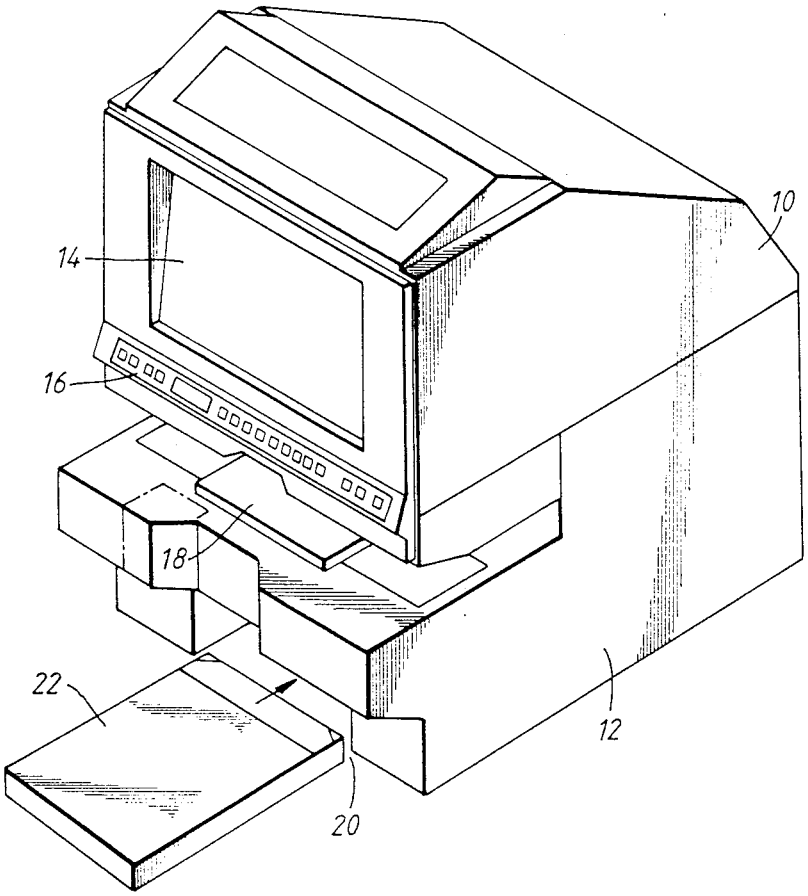
FIG. 1 is a perspective view of a microfilm reader printer according to the present invention.

FIG. 1 shows a microfilm reader printer as an embodiment of an image forming apparatus according to the present invention.

Referring now to FIG. 1, the microfilm reader printer includes a reader unit 10 and a printer unit 12. On reader unit 10, there is provided a screen 14 for displaying a magnified image according to an original image recorded on a microfilm, an operation panel 16 for instructing machine operations and displaying operational conditions, and a retainer 18 for supporting the microfilm thereon. Printer unit 12 has an access portion 20 where a cassette 22 accommodating copy sheets may be installed into and removed from the front side of the apparatus. The copy sheet with a copy image thereon is also discharged to access portion 20. Thus, the operations of projecting and printing the microfilm image may be achieved on the front side of the apparatus.

Figure 2:
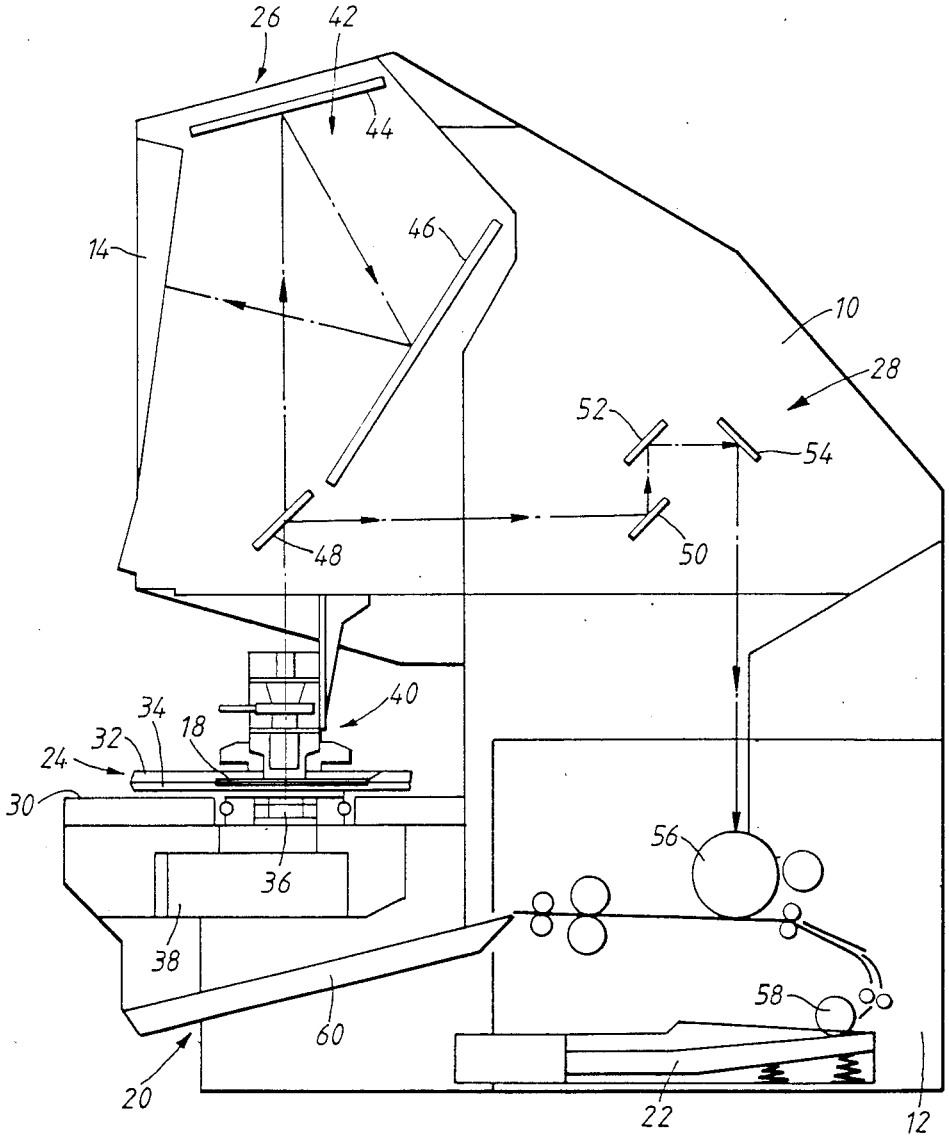
FIG. 2 is a schematic view of the inside of the microfilm reader printer.

Referring now to FIG. 2, there is shown the inside of the apparatus. Reader unit 10 has a film supporting unit 24 for locating the position of the microfilm, a projecting unit 26 for projecting the microfilm image onto screen 14 and a scanning unit 28 for scanning the microfilm image.

Film supporting unit 24 is provided on a table 30. Retainer 18 having transparent plates 32 and 34 is movably arranged on table 30 so that the microfilm held between transparent plates 32 and 34 may be located at a desired position. A condenser lens 36 and a light source 38 are provided beneath table 30. The above-mentioned components, i.e., retainer 18, table 30, transparent plates 32 and 34, condenser lens 36 and light source 38, define the film supporting unit 24. A light from source 38 is condensed through lens 36 and impinges on the microfilm supported between plates 32 and 34. Microfilm retainer 18 may be movable longitudinally and transversely in a plane above condenser lens 36. Thus, the desired original image may be located at any desired position above condenser lens 36 by moving retainer 18.

Projecting unit 26 includes a lens holder 40 for adjusting the focus and rotational angle of the image projected onto screen 14 and a light guide unit 42 for displaying a projected image on screen 14 according to the projected light incident from lens holder 40. This light guide unit 42 has mirrors 44 and 46 for directing the projected light from lens holder 40 to screen 14.

Scanning unit 28 includes a rotatable mirror 48 for scanning the projected image and directing the projected light to either projecting unit 26 or scanning unit 28. Scanning unit 28 further includes mirrors 50, 52 and 54 for guiding the scanning light reflected by rotatable mirror 48 to printer unit 12. Rotatable mirror 48 is disposed so that it may reciprocate in the perpendicular direction to the plane in FIG. 2 and rotate about an axis perpendicular to the plane of FIG. 2. Therefore, rotatable mirror 48 is held at a position far from lens holder 40 so as not to interfere the projected light while the projected light from lens holder 40 is guided onto screen 14. When the copying operation is desired, rotatable mirror 48 is moved to a position above lens holder 40 and rotated so that the projected light from lens holder 40 is reflected to mirror 50 and scanned to reproduce a copy. This rotatable mirror 48 is driven for the reciprocating movement by a motor ( not shown ).

Printer unit 12 has a rotating drum 56 having a photoreceptor such as Se thereon. The reflected light from mirror 54 is directed to the surface of drum 56 so that an electrostatic latent image according to the microfilm image is formed on the surface of drum 56 by exposure of the light image reflected from mirror 54. In printer unit 12, there is provided a feeding roller 58 for feeding copy paper from cassette 22 and a tray 60 for receiving the copy sheet.

Figure 3:
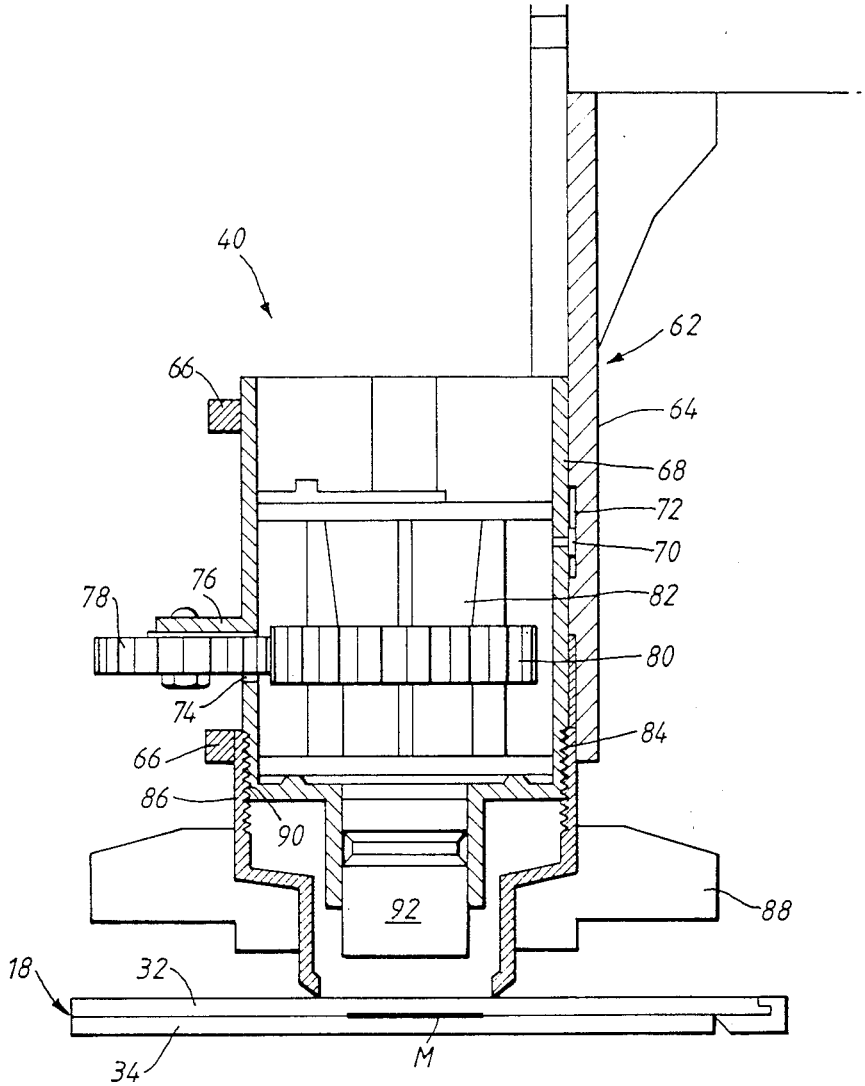
FIG. 3 is a schematic sectional view of a lens holder of the microfilm reader printer.

Referring now to FIG. 3, a holder 62 is attached to the front side of the apparatus below mirror 48. This holder 62 has a hollow cylinder including two halves, i.e., a base member 64 attached to the apparatus and a cover member 66 hinged to base member 64 by hinges ( not shown ). In holder 62, a casing 68, which is a cylindrical member and has a projection 70, is movably disposed therein. Projection 70 is received in a guide groove 72 provided on base member 64 and serves as a stopper for preventing casing 68 from freely rotating. The peripheral wall of casing 68 has an opening 74 and an outer projection 76. A gear 78 for adjusting the rotational angle of the projected image is supported by outer projection 76 and is meshed with a gear 80 through opening 74. A prism 82 is secured on the upper side of gear 80 so that prism 82 is rotated by rotating gear 78. Thus, the projected image rotates about the optical axis in accordance with the rotation of gears 78 and 80. The lower end of the outer periphery of casing 68 ha a thread 84. A focus adjusting member 86 formed in a stepped cylinder is coupled with the lower end of casing 68. This focus adjusting member 86 has a plurality of radially spaced vane-like members 88 projecting from the outer periphery and a thread 90 provided on the inner periphery thereof. Focus adjusting member 86 is coupled with casing 68 by engaging thread 90 thereon and thread 84 of casing 68. The lower end of member 86 is held in contact with microfilm retainer 18 due to the weight of casing 68 and member 86. Thus, focus adjusting member 86 is rotated in contact with retainer 18 by turning vane-like members 88, so that casing 68 is moved vertically in holder 62 because casing 68 is held by projection 70 and guide groove 72. Consequently, the distance between a lens 92 secured to casing 68 and retainer 18 is varied, whereby focus adjustment may be achieved. As shown in FIG. 3, the microfilm M is held between plates 32 and 34 located below lens holder 40; therefore, the light from condenser lens 36 illuminates microfilm M, and then is focused by lens 92.

Rotatable mirror 48 is attached to arms which are secured on a movable member (not shown). As the movable member is moved, its displacement is transmitted to rotatable mirror 48 through the arms whereby mirror 48 is driven to project light to the scanning unit 28 for optically scanning.

Figure 4:
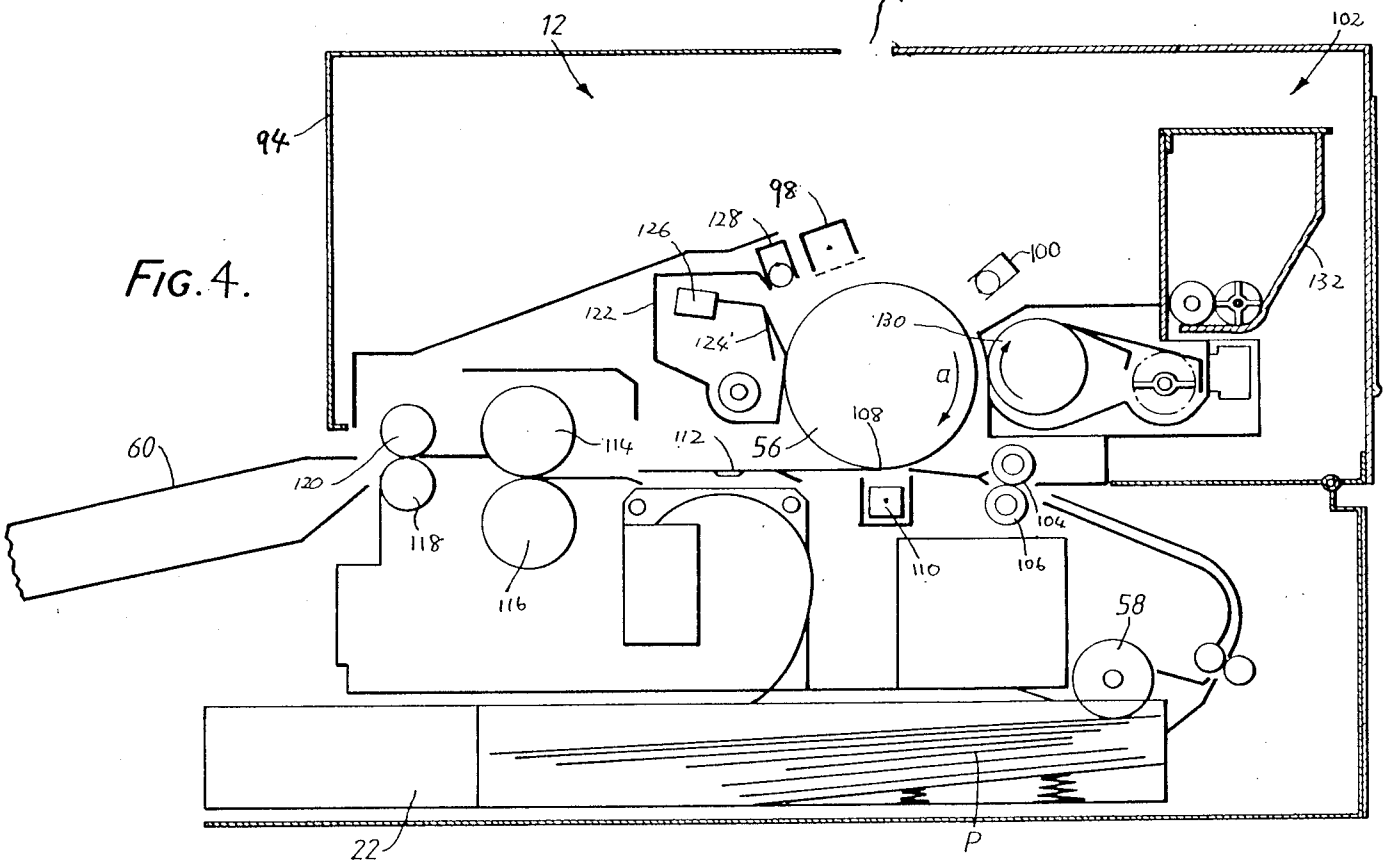
FIG. 4 is a schematic sectional view of the inside of a printer unit of the microfilm reader printer.

Referring now to FIG. 4, the detailed construction and operation of printer unit 12 will be described. FIG. 4 shows a schematic sectional view of printer unit 12.

In a casing 94 of printer unit 12, cassette 22 is mounted wherein copy sheets P are stored. On one side of casing 94, tray 60 is provided. This tray 60 may be removed. On an upper surface of casing 94, an exposure slit 96 is provided. This slit 96 permits the light image of scanning unit 28 to fall on the surface of drum 56. This drum 56 is rotated in the direction of an arrow a in FIG. 4. The light image from the scanning unit 28 is projected onto the surface of drum 56, and thus an electrostatic latent image is formed thereon. The surface of drum 56 is charged by a corona charger 98. Reference numeral 100 denotes an exposure lamp. The electrostatic latent image is visualized by depositing toner particles at a developing device 102.

Copy sheets P in cassette 22 are taken out one-by-one by feed roller 58 and are then guided by register rollers 104 and 106 to a transferring station 108. Accordingly, as drum 56 is rotated, the toner image carried on drum 56 is transferred to copy sheet P fed from rollers 104 and 106 at transferring station 108 by a transfer charger 110. After the toner image is transferred, copy sheet P is then separated from the surface of drum 56. After that, copy sheet P is transported by a conveyor 112 to fixing rollers 114 and 116. The transferred toner image is fixed on copy sheet P by rollers 114 and 116. Fixed copy sheet P is discharged outside casing 94 by discharge rollers 118 and 120 to be accumulated in tray 60. After transfer, residual toner particles on the surface of drum 56 are removed by a cleaner 122. This cleaner 122 has an elastic blade 124 for scraping off the residual toner particles and a solenoid 126 for bringing blade 124 into contact with drum 56. Also, any residual electrostatic image is discharged by an erase lamp 128, so that printer unit 12 returns to an initial state to repeatedly print copy images.

Developing device 102 has a developing unit 130 and a toner supply unit 132.

Figure 5:
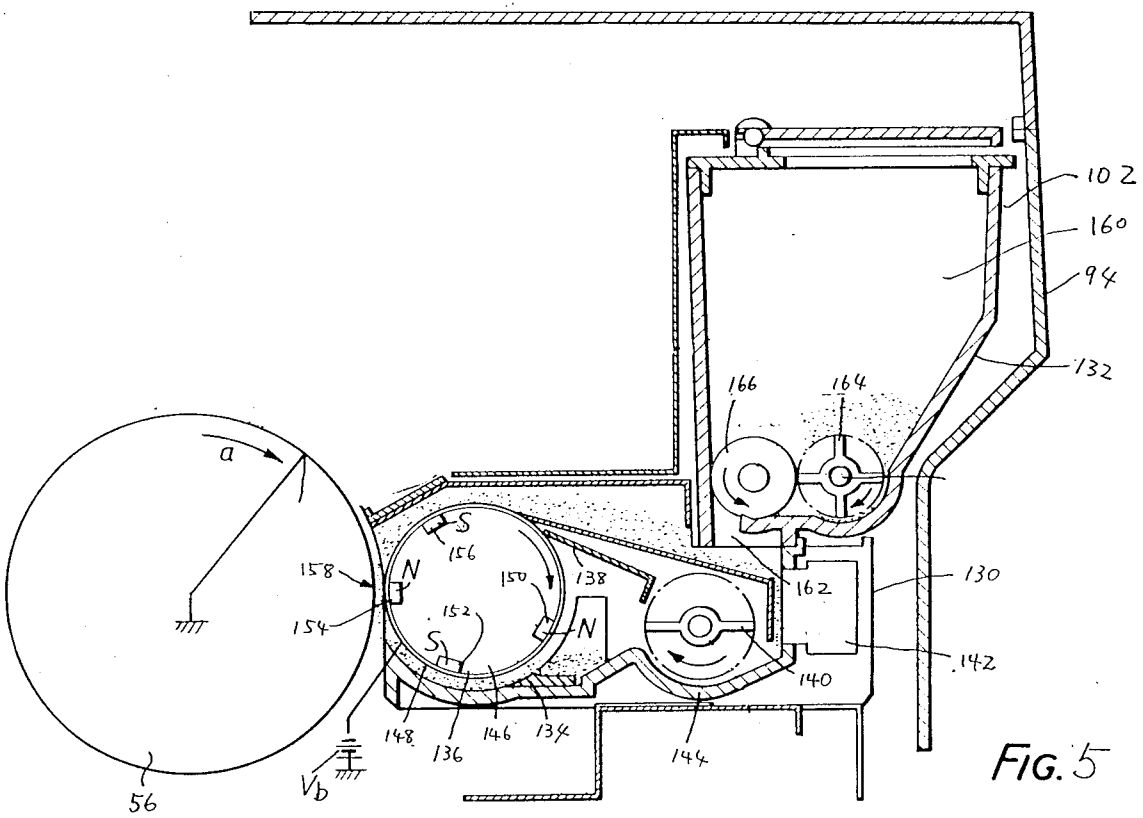
FIG. 5 is a schematic sectional view of the inside of a developing device of the microfilm reader printer.

Referring now to FIG. 5, there is shown the detailed structure of developing device 102. Developing unit 130 has a doctor 134 opposed to a developing roller 136 for adjusting the thickness of a developer layer formed on developing roller 136, a scraper 138 disposed on developing roller 136 for scraping off the developer layer, and a developer agitator 140. A sensor 142 is mounted on a casing 144 of unit 130. Sensor 142 detects the developer concentration in casing 144. Developing roller 136 includes a fixed magnetic roller 146 and a cylindrical sleeve 148 made of nonmagnetic materials and surrounding magnetic roller 146. This magnetic roller 146 has four magnetic poles 150, 152, 154 and 156. Sleeve 148 is rotated in the clockwise direction so that the developer is transported from agitator 140 to a developing position 158 by carrying the developer on the surface of sleeve 148. A hopper 160 is provided above unit 130. This hopper 160 accommodates toner particles and replenishes the toner through a toner outlet 162. In hopper 160, there are provided an agitator 164 and a replenishing roller 166 disposed above outlet 162. Thus, the toner particles stored in hopper 160 are stirred by agitator 164 and replenished by roller 166 through outlet 162 according to the detection of sensor 142. In casing 132, the developers including carrier particles made of iron powder and the toner particles replenished by roller 166 are mixed so that the toner particles have a sufficient charge to be deposited on the latent image by an electrostatic force. The charged toner particles and the carrier particles are attracted to each other and are transported to developing roller 136. Developing roller 136 carries the developer including the carrier and toner thereon by means of the magnetic force of magnetic roller 136. By rotating sleeve 148, the developer carried on the surface of sleeve 148 is transported to developing position 158 through doctor 134 whereat the thickness of the developer supported on sleeve 148 is restricted so as to form a layer of the developer on the surface of sleeve 148. This developer layer is called a magnetic brush. Thus, the toner of the developer is transferred to the surface of drum 56 at position 158 by the electrostatic force established between the latent image and sleeve 148. After that, the magnetic brush is scraped from sleeve 148 by scraper 138 and then returned to agitator 140. A bias voltage Vb is applied between sleeve 148 and drum 56 which is grounded, so that a voltage difference may be established.

Figure 6:
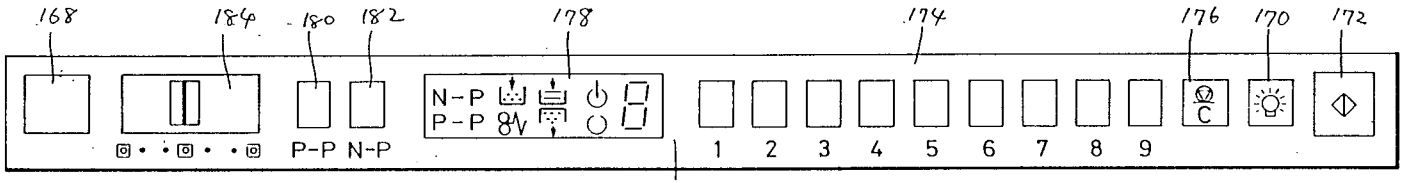
FIG. 6 is a plan view of an operational panel of the microfilm reader printer.

Referring now to FIG. 6, operational panel 16 will be explained in detail. This panel 16 has a main switch 168 for supplying electric power to the microfilm reader printer and a stand-by key 170 for de-energizing light source 38. When main switch 168 is operated, light source 38 is lit and the operations for projecting and printing the microfilm image are initiated. In this condition, light source 38 is extinguished when stand-by key 170 is operated in order to prevent rising temperatures in printer unit 12 and further to increase the lifetime of light source 38. Further, there are provided on panel 16 a P—P selection key 180 for performing normal development and an N—P selection key 182 for performing reverse development. Also, there are provided a print key 172 for initiating printing operation, a digital keyboard 174 for establishing copy quantity, a clear key 176 for changing the copy quantity established by digital keyboard 174, a display 178 for displaying selected developing operation, toner replenishment, sheet feeding, sheet jamming, copying operation, stand-by status and copy quantity and a knob 184 for establishing the image density of the copy.

Figure 7B:
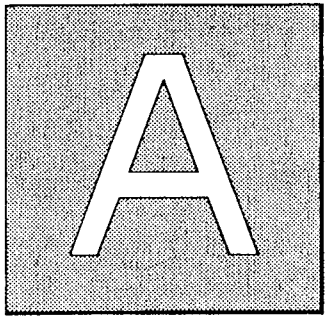
FIGS. 7*a* and 7*b* illustrate a positive original image and a negative original image, respectively.
Figure 7A:
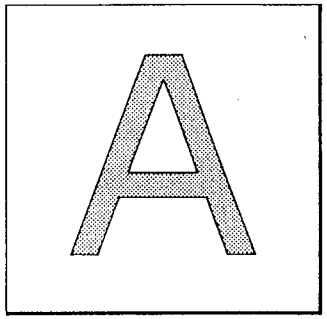

For the normal development, P—P selection key 180 is depressed, whereby a positive copy image may be formed from a positive microfilm image as shown in FIG. 7*a*. In this case, light to be projected onto the surface of drum 56 is other than the area constituting the character "A". For the reverse development, the N—P selection key 182 is depressed, whereby a positive copy image may be formed from a negative microfilm image as shown in FIG. 7*b*. In this operation, light to be irradiated onto the surface of drum 56 results from the light passed through a portion of microfilm M constituting a character "A".

Figure 8:
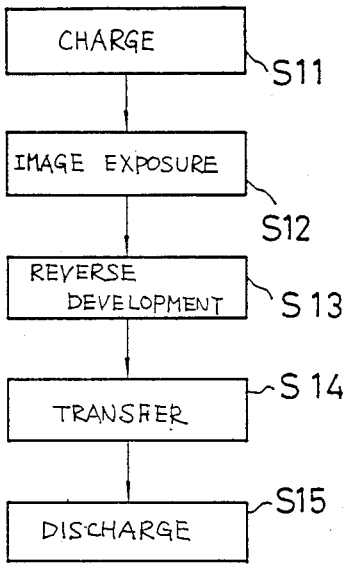
FIG. 8 is a flowchart showing a printing process of an N—P development.
Figure 9:
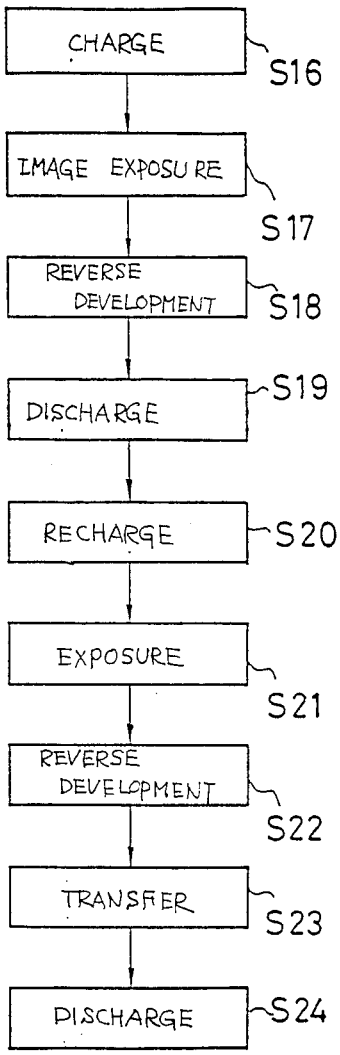
FIG. 9 is a flowchart showing a printing process for P—P development.

FIGS. 8 and 9 show a printing process of printer unit 12. In FIGS. 8 and 9, the steps shown enclosed in rectangles represent the electrophotographic process including charge, exposure, development, transfer and discharge.

To perform the N—P development, the N—P selection key 182 on operational panel 16 is depressed. Then, charger 98 is activated so as to charge the surface of drum 56 (S11). After that, a light image of microfilm M having a negative image is irradiated onto the surface of drum 56 so that an electrostatic latent image is formed on drum 56 (S12). The electrostatic latent image has image areas constituting an attenuated surface potential. Then, the electrostatic latent image is developed in reverse (S13), i.e., using negatively charged toner particles. The developed image is transferred to a copy sheet (S14). After that, the surface of drum 56 receives a discharge exposure in order to erase residual images.

To perform the P—P development, P—P selection key 180 on operational panel 16 is depressed. Then, charger 98 is activated so as to charge the surface of drum 56 (S16). A light image of microfilm M having a positive image is irradiated onto the surface of drum 56 so that an electrostatic latent image is formed on drum 56 (S17). The electrostatic latent image is developed in reverse (S18). Then, the surface of drum 56 receives an overall uniform exposure by erase lamp 128 (S19). After that, corona charger 98 is activated so as to uniformly recharge the surface of drum 56 (S20). The surface of drum 56 receives an overall uniform exposure by exposure lamp 100 (S21). Thus, a surface potential corresponding to image areas is attenuated by the overall illumination (S21). On the other hand, in non-image areas, a surface potential is held at a predetermined voltage because these areas are isolated from the overall illumination by the toner particles deposited on the non-image areas. Then, the electrostatic latent image is developed in reverse (S22). At the same time, a toner layer, deposited on a portion corresponding to the character "A", is removed by developing device 130. After that, the developed image is transferred to a copy sheet (S23) and the surface of drum 56 receives a discharge exposure by erase lamp 128 so as to erase residual latent images.

Next, referring now to FIGS. 10*a*–13*f*, the details of the image forming steps are described.

N—P development

Figure 10A:
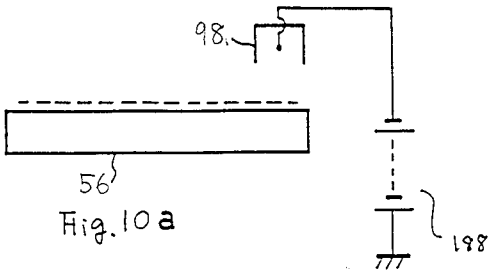
FIGS. 10*a*–10*d* illustrate image forming steps of the N—P development process.
Figure 11A:
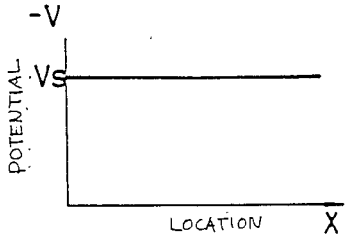
FIGS. 11*a*–11*c* are graphs for showing surface potential distributions on a photosensitive drum according to the N—P development process.
Figure 10B:
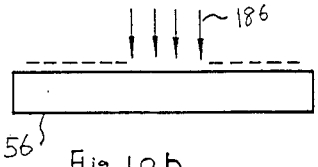
Figure 11B:
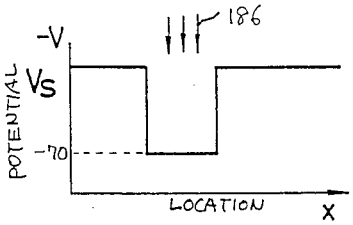
Figure 10C:
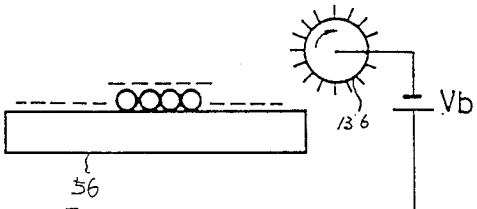

Corona discharger 98 utilizes a scolotron and is connected to a power supply 188. Corona discharger 98 negatively charges the surface of drum 56 so that a surface potential Vs becomes −600V in overall locations of drum 56 as shown in FIGS. 10*a* and 11*a*. Then, drum 56 receives scanning light images 186 from microfilm M. Scanning light images 186 are derived from a negative microfilm image as shown in FIG. 7*b*. Thus, surface potential Vs on drum 56, which corresponds to the portion of the character "A", is attenuated to about −70V as shown in FIGS. 10*b* and 11*b*. At this time, surface potential Vs on drum 56, which corresponds to the portion other than the character "A", is held at −600V regardless of image exposure operations. In FIG. 10*c*, a bias voltage Vb of −300V is applied between developing roller 136 and drum 56 (see FIG. 5).

Figure 11C:
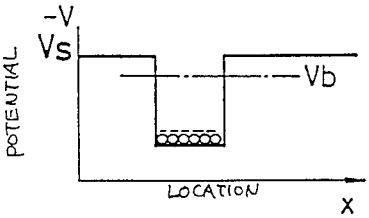
Figure 10D:
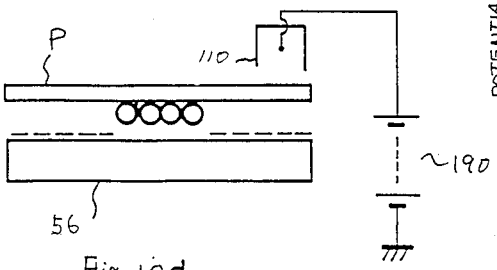

Casing 144 of developing device 130 accommodates a mixture of toner particles and carriers so that the mixture is triboelectrically charged by the operation of roller 136. According to the triboelectric series of two materials, the carriers become positively charged and the toner particles become negatively charged. As shown in FIG. 11*c*, the surface potential Vs on drum 56, which corresponds to the character "A", is held at a positive potential with respect to developing roller 136. Meanwhile, the toner particles have a sufficient charge to be attracted to the surface of drum 56, where the area for the character "A" is held at −70V to attract the negatively charged toner particles. Thus, the reverse development is performed so that the toner particles are deposited on the image areas corresponding to the character "A". After that, a copy sheet P is located at the transferring position so that the developed image is transferred to copy sheet P by charger 110 as shown in FIG. 10*d*. In this condition, charger 11*c* is connected to a power supply 190 having a voltage of +0.5kv so as to attract the negatively charged toner particles to copy sheet P. Subsequently, sheet P is separated from the surface of drum 56 by virtue of its own weight and beam strength. Next, copy sheet P carrying the positive copy image is transported to fixing rollers 114 and 116 through conveyor 112, whereby the positive copy image is fixed on sheet P. Thus, copy sheet P is discharged into tray 60 by discharge rollers 118 and 120. After the transferring operation, drum 56 faces cleaner 122 and erase lamp 128 in succession so as to remove residual toner particles and charges.

P—P development

In reference to FIGS. 12 and 13, it may be seen that corona discharger 98 includes a grid 192 connected to a power supply 194 in order to employ a scolotron. Corona discharger 98 negatively charges the surface of drum 56 so that surface potential Vs becomes −600V in overall locations of the drum 56 as shown in FIGS. 12*a* and 13*a*. Then, drum 56 receives scanning light images 186 from microfilm M. Scanning light images 186 are derived from a positive microfilm image as shown in FIG. 7*b*. Thus, surface potential Vs on drum 56, which corresponds to the portion other than the character "A", is attenuated to about −70V as shown in FIGS. 12*b* and 13*b*. At this time, surface potential Vs on drum 56, which corresponds to the portion of the character "A", is held at −600V regardless of the image exposure operations. In FIG. 12*c*, a bias voltage Vb of −300V is applied between developing roller 136 and drum 56. Casing 144 of developing device 130 accommodates a mixture of toner particles and carriers, wherein the carriers become positively charged and the toner particles become negatively charged according to the triboelectric series of the two materials. As shown in FIG. 13*c*, surface potential Vs on drum 56, which corresponds to the portion other than the character "A", is held at a positive potential with respect to developing roller 136. Meanwhile, the toner particles have a sufficient charge to be attracted to the surface of drum 56, where the area for the portion other than the character "A" is held at −70V to attract the negatively charged toner particles. Then, the reverse development is performed so that the toner particles are deposited on the portion other than the character "A" as shown in FIGS. 12*c* and 13*c*. The above steps are similar to those performed in the N—P process. Next, drum 56 faces erase lamp 128 without the image transferring operation and receives a discharging exposure by erase lamp 128. Then, as shown in FIGS. 12*d* and 13*d*, drum 56 faces corona charger 98 so that drum 56 and the toner layer on drum 56 are negatively charged again. The overall locations on drum 56 are held at a potential of about −600V. Next, drum 56 passes lamp 100 so that drum 56 receives a uniform exposure by lamp 100. As shown in FIGS. 12*e* and 13*e*, the surface potential Vs on drum 56, which corresponds to the portion of the character "A", is attenuated. On the other hand, for the portion other than the character "A" on the surface of drum 56, the surface potential Vs is held at about −600V.

Figure 12A:
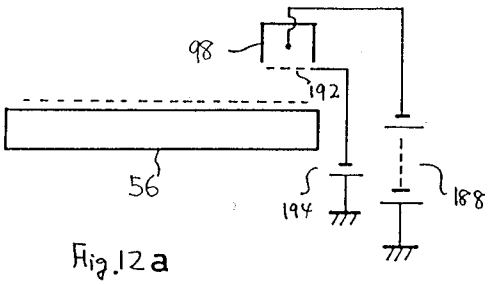
FIGS. 12*a*–12*f* illustrate image forming steps of the P—P development process.
Figure 12B:
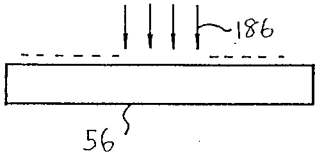
Figure 12C:
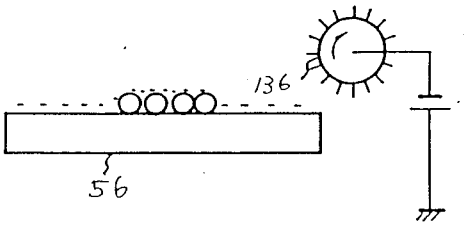
Figure 12D:
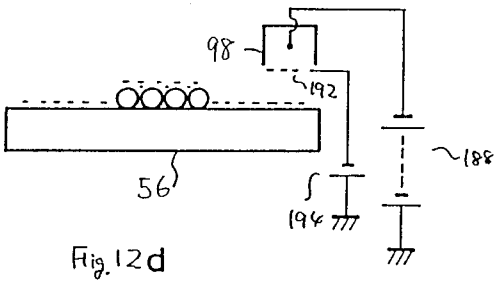
Figure 12E:
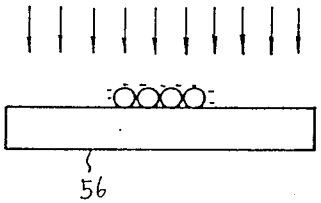
Figure 12F:
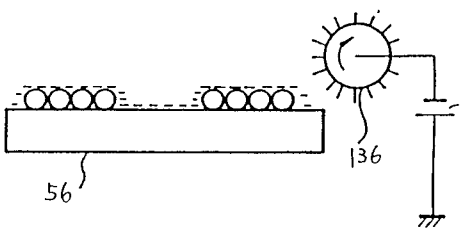
Figure 12G:
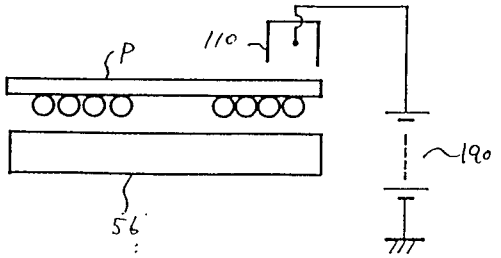
Figure 13A:
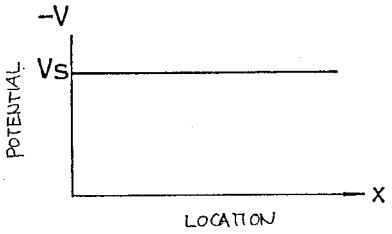
FIGS. 13*a*–13*f* are graphs for showing surface potential distributions on the drum according to the P—P development process.
Figure 13B:
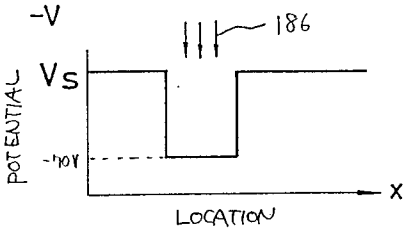
Figure 13C:
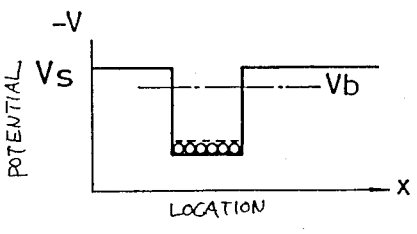
Figure 13D:
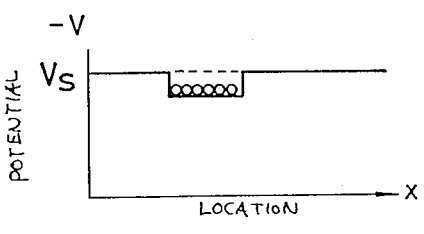
Figure 13E:
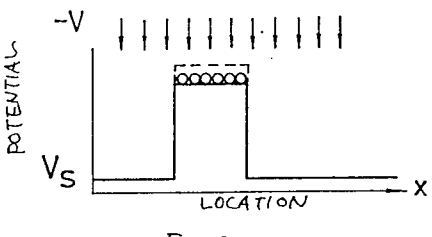
Figure 13F:
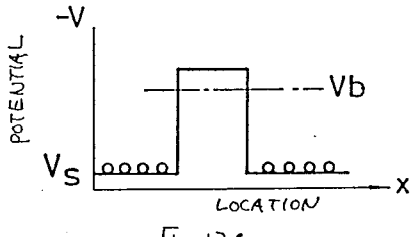

The uniform exposure by lamp 100 is intercepted by the toner layer deposited on the portion other than the character "A". Accordingly, the surface potential Vs of the toner layer portion is not attenuated. Then, as shown in FIGS. 12*f* and 13*f*, drum 56 faces developing roller 136 at developing position 158 so that toner particles are deposited by the Coulomb force onto the portion which corresponds to the character. At the same time, the toner layer, deposited on the portion other than the character "A", is scraped from the surface of drum by developing roller 136 at developing position 158. The reason is that the portion other than the character is negatively charged through the toner layer and does not receive the uniform exposure by lamp 100 by virtue of the filter effect of the toner layer. Accordingly, surface potential Vs of the portion other than the character "A" is held at a negative potential with respect to developing roller 136 connected to bias voltage Vb. Thus, the toner particles, deposited on the portion other than the character "A", are attracted to developing roller 136 by the Coulomb force. As described above, the positive microfilm image is projected onto the surface of drum 56 so as to form the positive latent image. The positive latent image is developed in reverse, i.e., using negatively charged toner particles. Then, the reversely developed image receives the recharging, discharging and re-reverse developing operations so as to produce the positive toner image. Paper sheet P supplied from cassette 22 is fed by rollers 58, 104 and 106 and guided to transfer charger 110. Then, as shown in FIG. 12*g*, the positive toner image on the surface of drum 56 is transferred onto paper P by charger 110 at transferring station 108 according to the rotation of drum 56. After that, paper P passes conveyor 112 and then is guided to fixing rollers 114 and 116. The transferred image is fused and fixed by rollers 114 and 116. Paper P carrying the transferred image is discharged into tray 60 by discharging rollers 118 and 120. Also, drum 56 faces cleaner 122 and erase lamp 128 in succession so as to remove residual toner particles and charges.

As shown in FIG. 4, cleaner 122 has solenoid 126 for bringing blade 124 in contact with drum 56. Solenoid 126 holds blade 124 out of contact with drum 56 so as to perform the re-reverse developing operation for the P—P development. Also, for the P—P development it is necessary to make the periphery length of rotation of drum 56 longer than the length of paper P in order to achieve the recharging, discharging and re-reverse developing operations.

Operation

Now, the operation of the overall microfilm reader printer mentioned above will be briefly described.

For projecting the microfilm image onto screen 14, the microfilm is positioned between transparent plates 32 and 34. Next, light source 38 for projecting the microfilm image is turned on by operating main switch 168 provided on operation panel 16. Thus, the microfilm image is projected onto screen 14 in an enlarged size. The focus adjustment is accomplished by turning vane-like members 88 of focus adjustment member 86. The positioning of the projected image on screen 14 is established by moving retainer 18 carrying the microfilm in the longitudinal and transverse directions. Also, the projected image on screen 14 is readily rotated, if necessary, by turning gear 78 so as to rotate prism 82.

For printing the enlarged size projected image, stand-by key 170 provided on panel 16 may be operated to turn off light source 38. Then, rotatable mirror 48 is displaced in the perpendicular direction to the plane in FIG. 2 by operating a key or knob (not shown), thereby positioning mirror 48 for printing. When the heater of fixing rollers 114 and 116 has been warmed up to a predetermined temperature and a ready-to-print display is provided on display 178, stand-by key 170 may be operated to start the printing operation. Then, either selection key 180 or 182 is operated in conformity with the type of image recorded on the microfilm. The copy quantity may be established by operating digital keyboard 174 and the operation for printing the copy image is performed by depressing print key 172. Now, the projected light from lens holder 40 is scanned by mirror 48 driven in synchronization with the rotation of drum 56 and is diverted onto the surface of drum 56 through exposure slit 96. Meanwhile, the surface of drum 56 is previously charged by charger 98 in accordance with the type of development, and an electrostatic latent image is formed on drum 56 according to the scanning exposure. When the image on drum 56 rotates adjacent developing device 130, a toner image is formed by developing device 130. The developed image is transferred onto copy sheet P by charger 110 in the manner depending on the type of development. Copy sheet P is then separated from drum 56. Copy sheet P is then fed to fixing rollers 114 and 116 by conveyor 112, where the transferred image is fixed onto copy sheet P by fusion. Sheet P is discharged onto tray 60 by rollers 118 and 120. The residual toner on drum 56 is removed by cleaner 122 and the residual charge is erased by lamp 128 so as to be ready for the next printing cycle.

Figure 14:
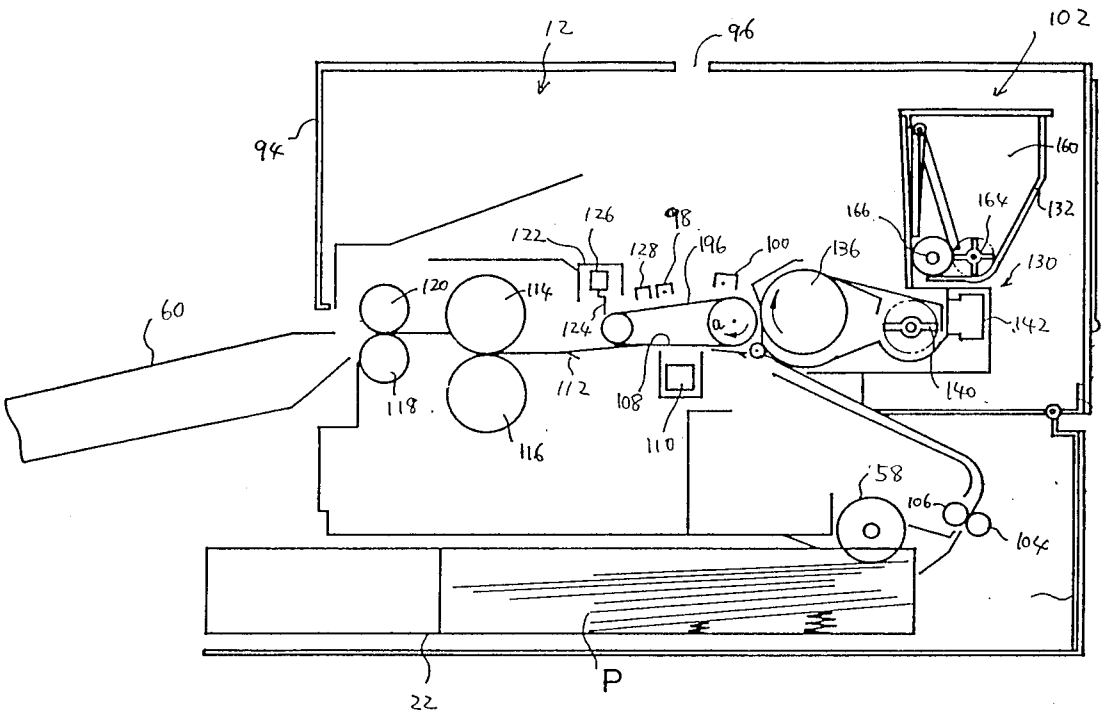
FIG. 14 is a schematic sectional view of the inside of a printer unit of another embodiment of the present invention.

The above embodiments are given only for the purpose of illustrating the invention. Numerous modifications and variations of the present invention are possible in light of the above teachings. For example, a photosensitive member for forming an image thereon may take the form of an endless belt instead of a drum. As shown in FIG. 14, a photosensitive belt 196 is positioned at the center of casing 94. Photosensitive belt 196 has a photoreceptor such as OPC (organic photoconductor) thereon. A different type of printer unit 12 is shown in FIG. 14 and has the same components found in the embodiment shown in FIG. 4. Also, the same components may be referred to by their respective same reference numerals without additional description.

As has been described in the foregoing explanation, one of first and second developing modes may be selectively performed so that the copy image may be readily and quickly obtained from both types of microfilm.

Numerous modifications and variations of the present invention are possible in light of the above teachings. It is therefore to be understood that within the scope of the appended claims, the present invention may be practiced otherwise than as specifically described herein.

What is claimed is:

1. An apparatus for forming a positive copy image on an image carrier from one of a negative and positive original images, comprising:
- means for uniformly charging the image carrier;
- means for exposing one of the negative and positive original images to the image carrier so as to form an electrostatic latent image thereon;
- means for reversely developing the electrostatic latent image by applying developers so as to reproduce a visible image;
- means for uniformly recharging the image carrier having the visible image corresponding to the positive original image and developed by said reversely developing means;
- means for uniformly discharging the image carrier recharged by said uniformly recharging means; and
- means for removing the developers on the visible image developed by said reversely developing means and for depositing the developer onto the image carrier so as to produce the positive copy image corresponding to the positive original image.

2. The apparatus of claim wherein said reversely developing means and said removing and developing means commonly utilize a developing member biased at a predetermined potential with respect to the image carrier.

3. The apparatus of claim 1, wherein said uniformly charging means and said uniformly recharging means commonly utilize a corona discharger of a scolotron type.

4. The apparatus as recited in claim 1 further comprising means for displaying said one of said negative and positive original images.

5. The apparatus as recited in claim 4 wherein said display means includes a screen for projecting said image thereon.

6. The apparatus as recited in claim 4 further comprising a control console having a function select key for selecting operation of said apparatus for one of said negative and positive original images.

7. An apparatus for forming a positive copy image on a copy sheet from one of a positive and negative original images, comprising:
- a rotatable photosensitive member;
- a corona discharger for charging said photosensitive member;
- a first light source for projecting one of the original images onto said photosensitive member charged by said corona discharger so as to form an electrostatic latent image thereon;
- a developing member for applying developers to the electrostatic latent image;
- a second light source for uniformly illuminating said photosensitive member;
- wherein said corona discharger performs recharging operations for said photosensitive member; and
- wherein said developing member removes the developers applied onto the electrostatic latent image and deposits developers on said photosensitive member after the recharging operations; and
- a transferring discharger for transferring the developer image deposited on said photosensitive member by said developing member to the copy sheet so as to form the positive copy image in accordance with one of the positive and negative original images.

8. An apparatus for reproducing a positive copy image on a copy sheet from one of a positive and negative original images, comprising:

means for forming a latent image corresponding to one of the original images on an image carrier;

means for developing the latent image formed by said forming means by applying developers to the image carrier;

means for transferring the developed image developed by said developing means onto the copy sheet when the latent image corresponds to the negative original image;

means for re-developing the developed image developed by said developing means by removing the developers and applying new developers to the image carrier; and means for transferring the re-developed image developed by said re-developing means onto the copy sheet when the latent image corresponds to the positive original image.

9. An apparatus for forming a positive copy image on a copy sheet from one of a positive and negative original images, comprising:

a photosensitive member;

corona means for charging said photosensitive member;

a first light source for projecting one of the positive and negative original images onto said photosensitive member charged by said corona means so as to form an electrostatic latent image thereon;

a developing member for applying developers to the electrostatic latent image;

a second light source for uniformly illuminating said photosensitive member during formation of said positive copy image with a positive original image;

wherein said corona discharger performs recharging operations for said photosensitive member when utilizing said positive original image; and wherein said developing member removes the developers applied onto the electrostatic latent image and deposits developers on said photosensitive member after the recharging operations when utilizing said positive original image; and a transferring discharger for transferring the developer image deposited on said photosensitive member by said developing member to the copy sheet so as to form the positive copy image in accordance with said one of the positive and negative original images.

10. The apparatus as recited in claim 9 further comprising means for displaying said one of said negative and positive original images.

11. The apparatus as recited in claim 10 wherein said display means includes a screen for projecting said image thereon.

12. The apparatus as recited in claim 9 further comprising a control console having a function select key for selecting operation of said apparatus for one of said negative and positive original images.

* * * * *